US006681528B1

(12) United States Patent
Profeta et al.

(10) Patent No.: US 6,681,528 B1
(45) Date of Patent: Jan. 27, 2004

(54) HATCH SAFETY RAILING SYSTEM

(75) Inventors: Jeff Profeta, Corona, CA (US); Scott Schellhase, Chino Hills, CA (US); Enrique Saucedo, Huntington Park, CA (US)

(73) Assignee: Activar, Inc., Minneapolis, MN (US)

( * ) Notice: Subject to any disclaimer, the term of this patent is extended or adjusted under 35 U.S.C. 154(b) by 0 days.

(21) Appl. No.: 10/268,388

(22) Filed: Oct. 10, 2002

Related U.S. Application Data

(60) Provisional application No. 60/391,295, filed on Jun. 24, 2002.

(51) Int. Cl.[7] ..... E02D 29/14; E04B 7/18

(52) U.S. Cl. ..... 52/20; 52/200; 52/72; 182/113; 182/45; 248/237; 256/65.14

(58) Field of Search ..... 52/20, 19, 200, 52/24, 25, 72; 182/112, 113, 45, 106; 256/65.14, 65.16, 65.01–65.03, 59; 248/231.9, 224.8, 300, 237

(56) References Cited

U.S. PATENT DOCUMENTS

| | | | | | |
|---|---|---|---|---|---|
| 2,137,751 | A | | 11/1938 | Davis | 108/1 |
| 3,016,238 | A | | 1/1962 | Malik | 268/102 |
| 3,278,149 | A | * | 10/1966 | Burcker | 248/239 |
| 3,615,110 | A | * | 10/1971 | Fugate | 403/230 |
| 3,995,833 | A | * | 12/1976 | McLaughlin et al. | 256/59 |
| 4,520,898 | A | * | 6/1985 | Allemane | 182/113 |
| 5,941,024 | A | * | 8/1999 | Journault | 52/20 |
| 6,053,281 | A | * | 4/2000 | Murray | 182/113 |
| 6,167,659 | B1 | | 1/2001 | Swindell | 52/20 |
| 6,272,800 | B1 | * | 8/2001 | Phinney et al. | 52/200 |
| 6,467,230 | B1 | * | 10/2002 | Perkins et al. | 52/655.1 |

FOREIGN PATENT DOCUMENTS

| | | | |
|---|---|---|---|
| DE | 3931156 | * | 3/1991 |
| FR | 2590612 | * | 5/1987 |
| FR | 2639057 | * | 11/1988 |
| JP | 1-280179 | * | 11/1989 |
| JP | 6-158809 | * | 6/1994 |

OTHER PUBLICATIONS

Oct. 10, 2002 printout from Internet site "www.thesafetyrailsource.com"entitled "The Safety Rail Source". Page 2 has photo detailing roof hatch having rail legs mounted by brackets onto coping and phrase "RailingReady Roof Hatches".

Precision Stair Corp. brochure copyright 1996. Photograph of "Ladder Hatch".

Oct. 10, 2002 printout from Internet site "www.thesafetyrailsource.com"entitled "The Safety Rail Source". Page 2 has photo detailing roof hatch having rail legs mounted by brackets onto coping and phrase "RailingReady Roof Hatches".

* cited by examiner

*Primary Examiner*—Winnie S. Yip
(74) *Attorney, Agent, or Firm*—Ralph D. Chabot

(57) ABSTRACT

A roof hatch safety railing to help prevent a person from accidentally falling through an open roof hatch while walking on a roof. The safety railing will comprise a top rail sufficiently high to prevent a person from falling over the railing. A mid-rail will also be located so that a person cannot accidentally fall under the top rail. The safety railing will be hingedly attached to the cover of the roof hatch as well as mounted to brackets which have been inserted into the coping of the base of the roof hatch. The safety railing will not interfere with the normal operation of the roof hatch and may be modified to accommodate various types and sizes of roof hatches.

6 Claims, 2 Drawing Sheets

HATCH SAFETY RAILING SYSTEM

PRIORITY CLAIM

This application claims the priority of US Provisional Application bearing serial No. 60/391,295 filed on Jun. 24, 2002.

TECHNICAL FIELD

This invention pertains to safety equipment for building structures and specifically to a railing system to be used with roof access hatches.

BACKGROUND OF THE INVENTION

Safety railing systems have been used in both new construction and existing buildings for many years. Typically, the rail systems have been firmly secured to the building about its periphery to prevent an accidental fall to a worker which can cause major and permanent injury.

The safety railing concept has also been applied to other locations for the prevention of an accidental fall from an appreciable vertical height. One location where safety railings have been adapted is in the area adjacent to a roof access hatch. These railings not only prevent accidental falls, but they also can serve as a grab bar to assist in balance for someone both climbing onto a roof and descending from the roof through the access hatch.

For a typical roof hatch installation, the hatch is positioned over a hole in the roof and is thus substantially supported upon the roof surface. The base of the hatch usually comprises a lower lateral support surface which contacts the roofing surface, a flange or vertical section, and coping above the flange. Insulation is typically positioned upon the outer flange surface and thereafter, roofing material is typically used to cover the lower lateral support and insulation surrounding the flange and then permanently bonded into position using a sealant applied to the roofing material adjacent to the coping. The sealant provides a water-proof seal to insure that water damage to the hatch installation will not occur.

U.S. Pat. No. 6,167,659 issued to Swindell discloses a safety railing system having at least one pole where each pole is secured in place between an associated bracket which is bolted to the base member of a roof access hatch adjacent the pole's lower end. The pole extends vertically and the upper end of the pole may be adapted with a handle to assist a person traversing through the hatch.

One drawback to the Swindell patent is that it is necessary to drill holes into the base member to facilitate attachment. As a result, these holes are drilled first through the roofing material, then through the insulation and finally through the flange. It is possible to compromise the integrity of the insulation, the roofing materials, or the gasketing in the immediate area surrounding the hatch thereby increasing the probability of undesirable water leakage.

Another prior art design utilizes a safety rail having brackets which are secured to the coping by using screws which threadably engage the coping. A problem associated with this type of design is the higher coping profile required for mounting the bracket. This bracket requires a wider coping surface to mount to than is commonly found on standard roof hatches in order for the cover to properly close.

SUMMARY OF THE INVENTION

Our safety railing system presents an alternative to those of the prior art. The safety railing system can incorporate a low profile, satisfy building code insulation requirements, and is easy to assemble and disassemble. It does not require that holes be drilled into the base member which can compromise the water seal integrity about the hatch installation.

The ability to quickly disassemble the railing from the hatch can be advantageous in certain situations. For example, if an item is desired to be lifted through the hatch opening, it may become snagged or caught on the railing making the lifting procedure more difficult.

Although a prior art railing which is directly bolted to the base can be disassembled and then reassembled, this design is not desirable because reassembly may not be as strong as the original assembly due to thread wear associated with the disassembly/reassembly procedure. By contrast, our design uses brackets which do not impose any detrimental wear to the coping. The vertical rail legs of our safety railing can be removed and then repositioned for attachment. Attachment can utilize new bolts and nuts thereby avoiding the possibility of damage associated with thread damage to the coping which may occur with direct bolt attachment.

Our new rail system is designed to be an optional attachment to roof access hatches. When installed, the safety rail is designed to prevent a person from accidentally falling through an open roof hatch. The safety rail system can also serve the same function as a grab bar to assist a person when traversing through the roof hatch opening.

Our safety railing meets the Occupational Safety and Health Administration (OSHA) definition for a railing which requires that there be both a top horizontal rail and a mid rail; the top horizontal rail located at least 42 inches from the floor, and the mid rail located approximately half way between the top horizontal rail and floor. Our safety railing also satisfies the OSHA 200-pound load requirement for the top rail.

A unique feature of our hatch railing system is the mounting bracket design. Our hatch comprises a base having a vertical section and coping located at the top portion of the vertical section. The coping comprises a sidewall having a plurality of preformed openings or slits formed about its outer periphery, preferably, in the case of a square hatch design, about three of the four sides.

The vertical distance or height of the coping sidewall can be of a lower profile than that for the prior art bolting directly to the coping. This is because the portion of the mounting bracket inserted through the slit acts as a load bearing surface to the inside surface of the coping. A portion of this particular load bearing surface can be located nearer the top of the coping than the lowermost portion of the hatch cover when in the closed position. Therefore, a coping having less vertical height can be incorporated with our design. The access hatch cover can close without coming into contact with the mounting brackets of our design.

A mounting bracket is provided for each respective slit and is inserted into the slit located on the outer facing side of the base. The mounting bracket can be described as generally having a U-shape design, a mid-section and two distal portions extending away from the mid-section in a parallel direction. One of the distal portions incorporates an aperture near one end. The mounting bracket is sized so that the end portion of the bracket not having an aperture can be inserted into the slit so that the mounting bracket end portion having the aperture is outside of the slit and can be positioned for facilitating the securement of a respective rail leg to the coping.

When properly inserted into the slit, the mounting bracket will have most of its mid-section and the side having the aperture located outside the coping. Further, the end portion having the aperture will be orientated so that it will extend upward from the mid-section.

This orientation is necessary so that a respective leg of the safety railing can be supported upon the mid-section and secured in position typically by inserting a bolt or screw through the end portion aperture and into engagement with an appropriately sized hole adjacently located in the respective leg having a common axis of symmetry with the mounting bracket aperture. Another means for attaching rail legs to mounting brackets include the use of cotter pins but other methods common in the art can also be utilized. Another means, if removability is not desired, is to weld the bottom portion of the rail leg to a respective bracket.

In the preferred embodiment, each mounting bracket further comprises an offset brace which will contact and become a load bearing surface against the outside surface of the coping while the end portion received through the slit will become a load bearing surface against the inner surface of the coping.

The positioning of the mounting bracket partially within the base makes bolted attachment of the railing directly to the base not necessary.

In the preferred embodiment, two attachments of the rail system are made to the hatch cover, rather than to the base, along its hinge axis; one attachment on either side of the cover. In other words, two attachments are made to the cover of the roof hatch, preferably with shoulder bolts inline with the hinges, so that the cover may rotate freely between an open and closed position without interfering with the integrity of the safety railing, i.e. two legs of the rail are hingedly attached to the cover so the cover can rotate relative to the rail legs and base.

The dimensions for each slit located on the coping portion of the base member of the roof hatch are sufficiently wide and high to receive a mounting bracket. The "U" shape of the mounting bracket allows it to be easily inserted into the slit.

Each rail leg has a thickness designed to preferably support at least 200 pounds upon the top rail in any direction. Once each mounting bracket is properly positioned, and then secured to a respective rail leg, movement of each bracket is limited.

Bracket movement is limited from being pushed inward, vertically upward, or side to side by the location of the other safety railing mounting brackets and the presence of respective vertical leg members of the safety railing which are bolted to separate brackets, thereby mounted snugly between the outside end portion of the bracket and the vertical surface of the coping.

Functionality of the safety railing is critical when the roof hatch cover is in the open position. In this position, the open cover also provides stability to the railing portions immediately adjacent to the open hatch cover. This prevents the rear portion of the safety railing from being displaced in the horizontal direction more than the clearance between the hatch and the safety railing; preferably, this clearance is no more than two inches.

A rear rail is attached to the top rails of the roof hatch behind the open cover to provide support between the safety railings attached to either side of the roof hatch such that it will not interfere with the opening of the roof hatch cover. This rear rail, as well as both side rails, can be removed as mentioned earlier. Although the railing can be made as a single piece, preferably it is made in three separate sections to ship and handle more easily. The three piece embodiment would comprise a rear section preferably having a U shape design where both ends would be adapted for insertion into a respective side rail tubular opening which would be present on each adjacent side rail.

DETAILED DESCRIPTION OF THE PREFERRED EMBODIMENT

Figure 1:
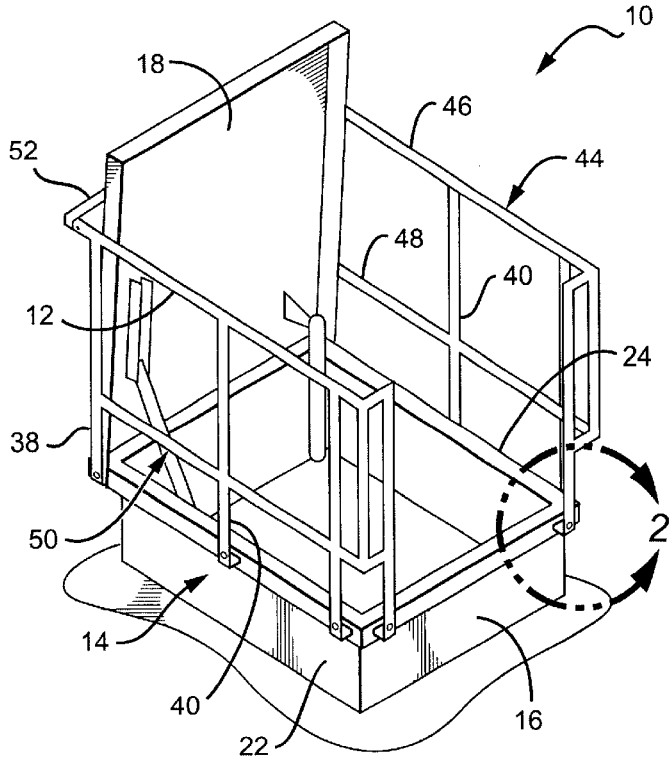
FIG. 1 is a perspective view of the railing system attached to a roof access hatch.

Our invention 10 comprises a safety railing 12 mounted to a roof access hatch 14 and is generally shown in FIG. 1.

Figure 4:
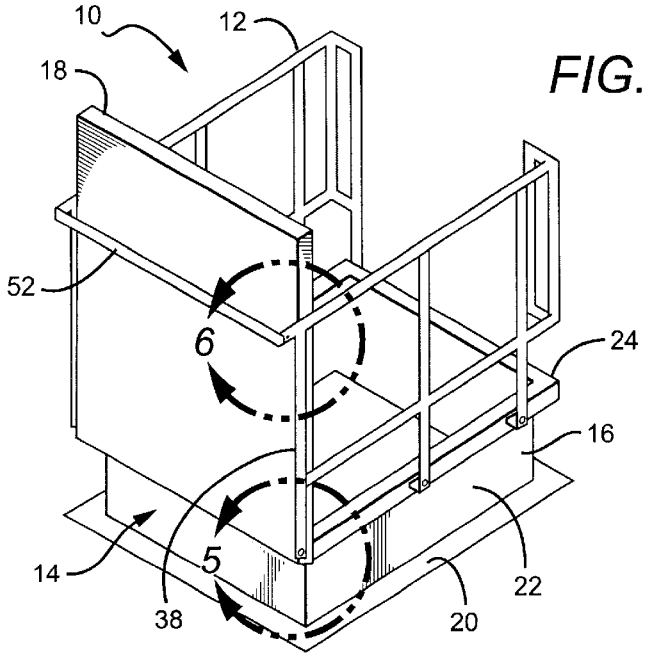
FIG. 4 is an alternate perspective view of FIG. 1 but including a lower lateral support.

Roof access hatch 14 comprises a base 16 and a cover 18 hingedly connected thereto. Best illustrated in FIG. 4, base 16 comprises a lower lateral support 20, a vertical extending sidewall, or flange 22, and coping 24.

Figure 7:
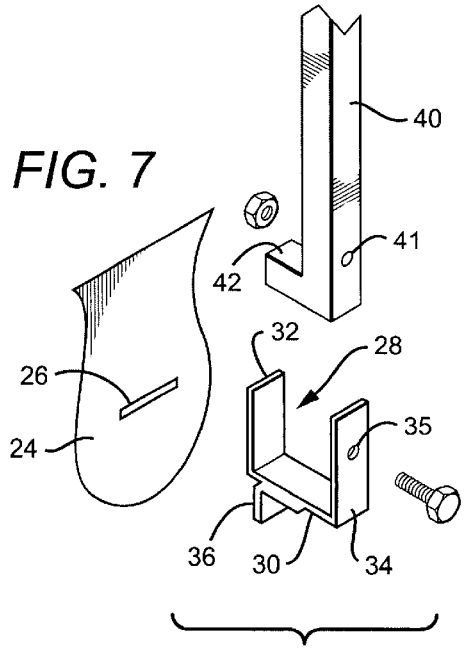
FIG. 7 is an exploded view illustrating the attachment of a rail leg to a mounting bracket and in turn the mounting bracket to the coping.

Referring to the exploded view of FIG. 7, a plurality of slits 26 are formed in coping 24. A mounting bracket 28 is provided for a respective slit 26 and is used to support safety railing 12 as will be discussed shortly.

Mounting brackets 28 have a general U-shape design comprising a middle portion 30 and end portions 32 and 34 respectively. Brackets 28 also comprise an offset brace 36 and end portion 34 further includes an aperture 35.

Figure 3:
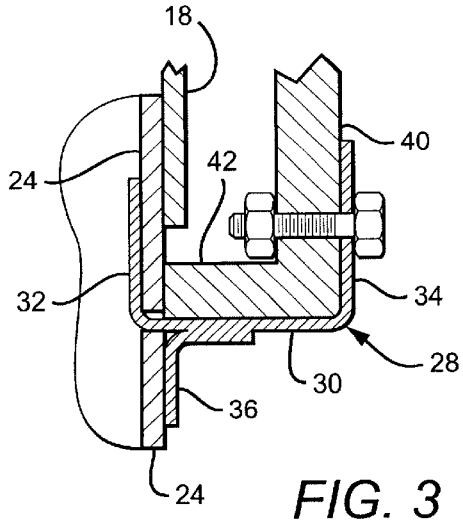
FIG. 3 is a cross section through the rail attach bracket taken along line 3—3 of FIG. 2.

End portion 32 is sized to be received through slit 26. Once inserted into slit 26, bracket 28 is orientated so that end portion 32 is contacting the inner wall of coping 24 and brace 36 is contacting the outer wall of coping 24 as illustrated in FIG. 3. Once in this position, end portion 34 extends in an upward direction. This procedure is repeated until all brackets 28 have been secured to coping 24.

In the railing design depicted, six mounting brackets 28 are secured to coping 24. The number of brackets can be increased or decreased and depends upon the rail design used so long as structural integrity of both the railing and the coping are not compromised.

Figure 2:
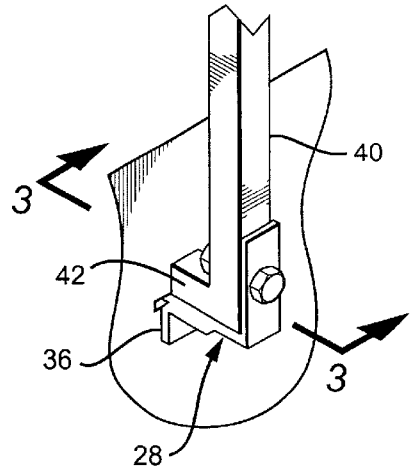
FIG. 2 is a perspective detail taken along view 2 of FIG. 1.
Figure 5:
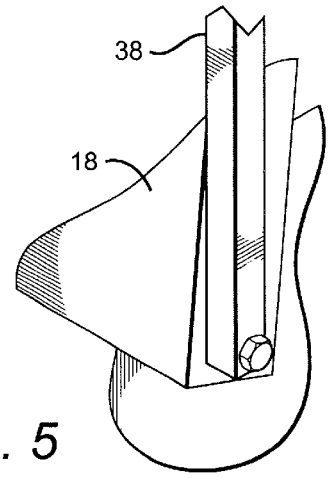
FIG. 5 is a close-up of view 5 of FIG. 4.

With all brackets 28 in position, safety railing 12 can be mounted to hatch 14. Safety railing 12 comprises two rear legs 38 for hinge engagement with cover 18, shown in FIG. 5, in addition to a plurality of legs 40 which correspond to the number of brackets 28 secured to coping 24, shown in FIG. 2. Each leg 40 has a foot 42 which is sized to rest upon middle portion 30 of bracket 28 substantially over the area between end portion 34 and the outer surface of coping 24. Each leg 40 has a hole 41 suitably located so it will have a common axis of symmetry with aperture 35. The alignment of aperture 35 and hole 41 permit legs 40 to be fastened to a respective bracket 28 by threaded engagement as shown in FIG. 3.

Figure 6:
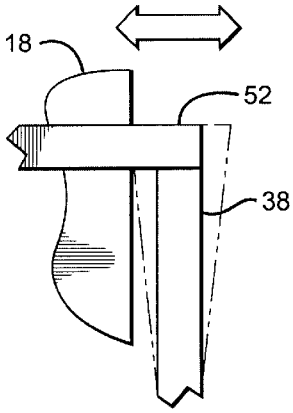
FIG. 6 is a close-up of view 6 of FIG., 4 and illustrates how the hatch, when in the open position, restricts lateral movement of the railing.

Safety railing 12 also comprises a left-side railing 44 comprising a top horizontal support member 46 and a mid horizontal support member 48, each attached to respective legs 40 and back leg 38. A right-side railing 50 is a mirror image of left side railing 44, and mounted on the opposite side. A rear railing 52 is also provided and which is attached to both side railing portions 44 and 50 as shown in FIG. 6; thus forming the entire safety railing 12.

With this configuration, safety railing 12 is strengthened; particularly when cover 18 is in the open position. When in the open position, cover 18 will prevent the adjacent portions of side railings 44 and 50 from displacing more than the open space present between cover 18 and rear legs 38.

We claim:

1. The combination of a roof access hatch and a safety railing comprising:

a roof access hatch comprising a base and a cover hingedly attached thereto so that the cover can be displaced into either an open or closed position, said base having a top portion defined as coping, said coping having a plurality of slits located about its outer periphery;

a safety railing positioned about said hatch, said safety railing having at least one vertical leg, a top horizontal bar and a middle horizontal bar;

at least one mounting bracket for attachment to said at least one vertical leg and for partial insertion into one respective slit, said mounting bracket having a middle portion and an end portion located on opposing sides of said middle portion, where one of said end portions is sized to be received through said respective slit;

said at least one mounting bracket is positioned so that one of said end portions is within said coping and the other of said end portions is outside said coping and is positioned to extend upward from said middle portion; and, where said at least one vertical leg is secured to said middle portion of said respective mounting bracket.

2. The combination of a roof access hatch and a safety railing of claim 1 wherein said at least one mounting bracket further comprise an offset brace extending downward from said middle portion for load bearing contact with the outside surface of the coping.

3. The combination of a roof access hatch and a safety railing of claim 1 wherein said safety railing comprises a rear railing, a left-side railing connected to said rear railing, and a right-side railing connected to said rear railing.

4. The combination of a roof access hatch and a safety railing of claim 3 wherein said at least one mounting bracket further comprise an offset brace extending downward from said middle portion for load bearing contact with the outside surface of the coping.

5. The combination of a roof access hatch and a safety railing comprising:

a roof access hatch having a base and a cover hingedly attached thereto so that the cover can be displaced into either an open or closed position, said base having a top portion defined as coping, said coping having a plurality of slits located about its outer periphery;

a mounting bracket associated with each said slit, said mounting bracket having a middle portion and an end portion located on opposing sides of said middle portion, where one of said end portion is sized to be received through said respective slit;

each of said mounting brackets is positioned so that one of said end portions is inserted within said respective slit on said coping and the other end portion having the aperture is outside said coping and as positioned to extend upward from said middle portion;

a safety railing comprising a left-side railing and a right side-railing connected to each other by a rear railing positioned behind the cover when the cover is in an open position, each of said side-railings having a rear leg being hingedly attached to the cover, and a plurality of other legs being mounted upon said brackets.

6. The combination of a roof access hatch safety railing of claim 5 wherein each of said mounting brackets further comprise an offset brace extending downward from said middle portion for load bearing contact with the outside surface of the coping.

* * * * *